United States Patent [19]

Marinoni et al.

[11] 4,235,049

[45] Nov. 25, 1980

[54] EDGE FITTING ASSEMBLY FOR A PANEL

[75] Inventors: Mirko Marinoni; Mario Marinoni, both of Magenta, Italy

[73] Assignee: Casma di B. Marinoni & Figli, Magenta, Italy

[21] Appl. No.: 9,430

[22] Filed: Feb. 5, 1979

[30] Foreign Application Priority Data

Feb. 8, 1978 [DE] Fed. Rep. of Germany ..... 2805258
Sep. 19, 1978 [DE] Fed. Rep. of Germany ..... 2840727

[51] Int. Cl.[2] ..... E06B 7/16

[52] U.S. Cl. ..... 49/488; 52/824; 52/825

[58] Field of Search ..... 49/501, 488, 462; 52/821, 824, 825, 822

[56] References Cited

U.S. PATENT DOCUMENTS

| | | | |
|---|---|---|---|
| 2,133,199 | 10/1938 | Kammerer | 49/488 |
| 2,777,173 | 1/1957 | Caswall | 49/501 X |
| 3,653,156 | 4/1972 | Horgan, Jr. | 49/501 |
| 3,672,424 | 6/1972 | Brown | 49/488 X |
| 3,798,863 | 3/1974 | Latson | 52/824 X |
| 3,821,870 | 7/1974 | Sittmann | 52/825 |
| 3,828,394 | 8/1974 | Horgan, Jr. | 49/501 X |

*Primary Examiner*—Philip C. Kannan
*Attorney, Agent, or Firm*—Toren, McGeady and Stanger

[57] ABSTRACT

The edge fitting assembly for the bottom edge of a glass door includes two bars elongated in a common, horizontal direction and spaced from each other at right angles to the common direction. Two fastening blocks are releasably secured in longitudinally spaced relationship between the bars and at least partly covered by the bars. The blocks define respective, upwardly open, aligned grooves in which the bottom edge of the door panel is received. Each bar is enveloped by a cover of sheet material which is locked to the bar by an elongated locking member simultaneously received in a groove formed in one of the two narrow edge portions of the bar and a groove defined in the portion of the cover which envelops the edge portion in such a manner that the cover cannot move away from the wide face portion of the bar which connects the edge portions.

16 Claims, 4 Drawing Figures

EDGE FITTING ASSEMBLY FOR A PANEL

This invention relates to an edge fitting assembly for a panel, and particularly to an edge fitting assembly for the bottom edge of a door consisting mainly of a glass panel.

Known fitting assemblies for glass doors are aesthetically unsatisfactory if they show fastening elements in their exposed surfaces. If the fastening elements, such as screw heads, are to be concealed, the labor involved in securing the parts of known fitting assemblies to each other and to glass panels is relatively costly because of complex structure. Assemblies having concealed fastening elements, moreover, tend to shake loose during use so as to rattle.

The primary object of this invention is the provision of a fitting assembly of the type described which is assembled quickly by unskilled personnel, reliably maintains its tight fit on the door panel, and the tight fit of the several assembled fitting elements, and presents an aesthetically pleasing appearance.

With this object and others in view, the invention, in one of its more specific aspects, provides an edge fitting assembly for a panel which comprises two bar members elongated in a common direction and spaced from each other in a direction perpendicular to the common direction. Two fastening blocks are releasably secured between the bar members and at least partly covered by the latter. The blocks are spaced from each other longitudinally of the bar members. Each fastening block defines a panel-receiving groove aligned longitudinally with the groove in the other fastening block and open in a direction transverse to the afore-mentioned common and perpendicular directions.

In another specific aspect of the invention, at least one of the bar members has two narrow longitudinal edge faces and a wide longitudinal face connecting the edge faces. At least one of the edge faces is formed with a longitudinal groove. A cover has two first portions respectively enveloping the edge faces and a second portion enveloping the wide face of the bar members. One of the first portions defines a longitudinal groove opposite the groove of the enveloped edge portion. A locking member simultaneously received in the opposite grooves of the first cover portion and the enveloped edge portion prevents movement of the second cover portion away from the wide face of the bar member.

Other features, additional objects, and many of the attendant advantages of this invention will readily be appreciated as the same becomes better understood from the description of preferred embodiments when considered in connection with the appended drawing in which.

Figure 3:
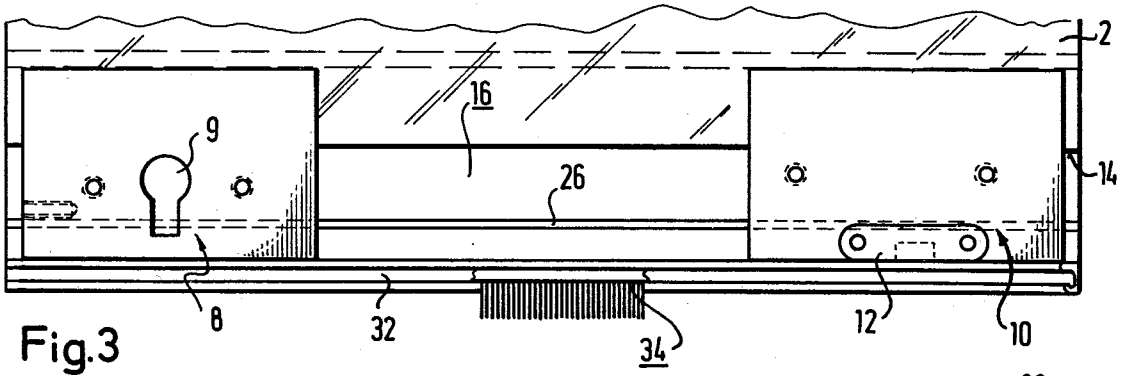
FIG. 3 illustrates the panel of FIG. 1 and elements of the fitting assembly mounted thereon in front elevation.

Referring initially to FIG. 3, there is seen a door panel 2 of plate glass whose straight bottom edge 14 is received in aligned grooves of two fastening blocks 8, 10 threadedly attached to a wide face of a bar 16 of extruded aluminum alloy. The block 8 encloses a lock of which only a keyhole 9 is seen in FIG. 3, the lock being conventional and permitting the door panel to be locked to the door sill. The other fastening block 10 carries a plate 12 for attachment to a hinge, as is also conventional. A longitudinal groove 26 facilitates slight bending of the lower edge portion of the bar 16. Another groove 32 near the lower edge of the bar 16 which projects downward beyond the blocks 8, 10 receives the backs of brushes 34 of which only one is shown in FIG. 3, and which minimize draft through the gap between the lower edge of the bar 16 and the door sill.

Figure 1:
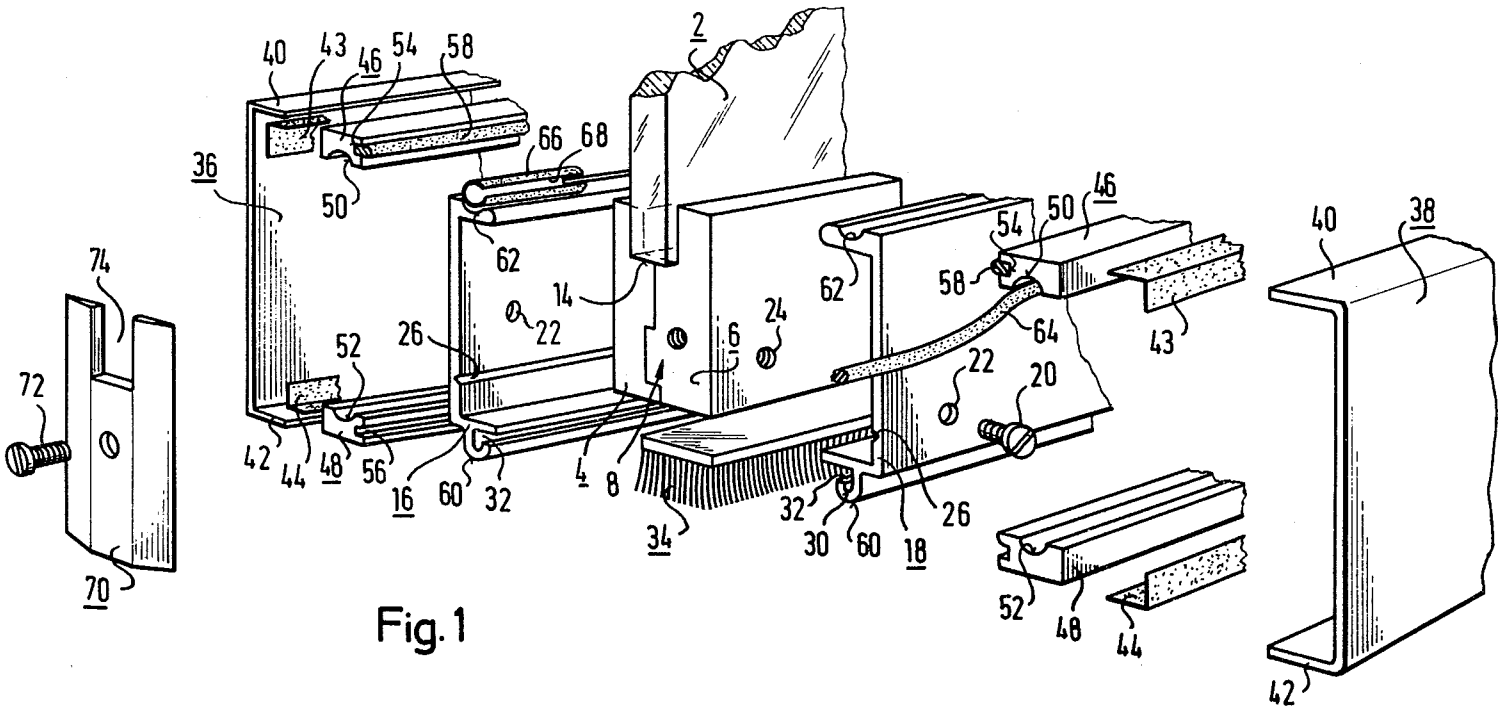
FIG. 1 is an exploded, fragmentary, perspective view of an edge fitting assembly of the invention and of the associated glass panel.
Figure 2:
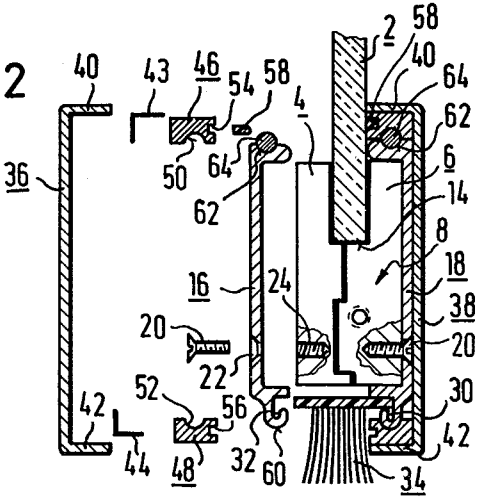
FIG. 2 shows the device of FIG. 1 in side-elevational cross section, partly assembled.

As is better seen in FIGS. 1 and 2, the blocks 8, 10 consist each of two interfitting parts 4, 6 which are adhesively fastened to each other and to the glass panel 2, the panel-receiving groove of each block 8, 10 being jointly bounded by the two parts 4, 6. The blocks are fastened between two bars 16, 18, of identical cross section, by means of screws 20 passing from the outer, wide face of each bar through oversized, smooth bores 22 in the bars 16, 18 into tapped bores 24 in the block parts 4, 6 in the assembled condition of the device. Narrow longitudinal edge flanges project from the bars 16, 18 toward each other, and the lower flanges carry channels 30 which are approximately J-shaped in cross section and open toward each other to define the afore-mentioned grooves 32 receiving the backs of the brushes 34 in longitudinally sliding engagement.

The heads of the screws 20, the channels 30, the blocks 8, 10, and other elements associated with the bars 16, 18 are concealed by covers 36, 38 which are shallow channels. Their upper and lower flange portions 40, 42 envelop the corresponding edge flanges of the bars 16, 18, whereas the web portions envelop the wide, outer longitudinal faces of the bars. Strips 43, 44 of sheet material, coated with pressure-sensitive adhesive on both faces, are attached to the inner faces of the covers 36, 38 where the flanges join the web and attach sections 46, 48 of extruded aluminum rod to the flanges 40, 42. Longitudinal grooves 50 of approximately semi-circular cross section in the rods 46 face corresponding grooves 52 in the rods 48 on the same cover. Rectangular, longitudinal grooves 54 in the rods 46 associated with the two flanges 40 are open horizontally toward each other, as are corresponding grooves 56 in the rods 48. The grooves 54 receive resilient sealing strips 58 which engage the glass panel 2 in the assembled door, as is shown in FIG. 2. The grooves 56 do not perform a useful function, but permit the rods 46, 48 to be made of the same extruded stock.

After bars 16, 18 are attached to the blocks 8, 10 by means of screws 20, the covers 36, 38 may be snapped over the bars in a position in which the convexly arcuate, outer longitudinal faces 60 of the channels 30 are received in the grooves 52 of the associated rods 48, and the grooves 50 on the rods 46 face similar grooves 62 in the upper edge flanges of the bars 16, 18. A locking rod 64 of flexible plastic or a locking tube 66 having a longitudinal slot 68 may now be slid into the approximately cylindrical passage formed by grooves 50, 62 to lock the covers 36, 38 to the bars 16, 18. The web portions of the covers no longer can move away from the wide, outer, longitudinal faces of the bars. The slotted tube 66 may be fastened adhesively in the associated groove 62 prior to snapping the cover 36 over the bar 16 if so desired.

The two blocks 8, 10 are mounted near the two ends of the edge 14 on the panel 2, and the seam between the two block parts 4, 6 is hidden by a face plate 70 attached to the part 6 by a single screw 72. A notch 74 in the face plate receives the corner of the panel 2 which projects beyond the block 8 and is flush with the attached face plate 70. The head of the screw 72 is the only fastening element of the edge fitting assembly which remains exposed in the finished door, but is not normally visible in the gap between two cooperating door panels or between a single door panel and a door jamb.

The panel edge fittings of the invention are assembled quickly by means of a screw driver for inserting the two screws 20 and the one screw 72 associated with each block 8, 10, but otherwise by means of adhesive materials and snap fits of cooperating elements. A tight connection between the several fitting elements is maintained for the life of other door elements, such as the hinges and locks, and the fitting assembly is securely fastened to the door panel.

Figure 4:
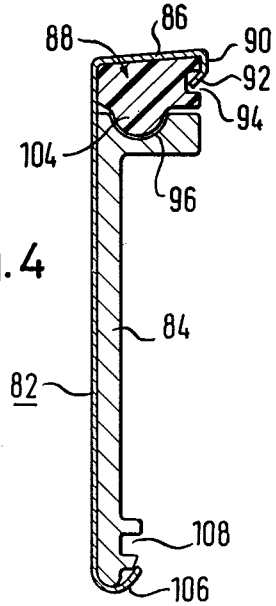
FIG. 4 is a side elevational, sectional view of elements of a modified fitting assembly.

Similar advantages are achieved in an otherwise identical assembly with the simplified bar and cover illustrated in FIG. 4. The cover 82 consists of sheet metal and envelops the two narrow edge faces of a bar 84 of extruded aluminum alloy and the wide, outer longitudinal face of the bar which connects the edge faces. A longitudinal groove 96 in one edge face is of approximately semi-circular cross section and conformingly engaged by a rib 104 of a locking element 88 of extruded plastic. The upper flange portion 86 of the cover 82 holds the rib 104 in the groove 96, and the locking element 88 is further secured by a skirt 90 depending from the flange portion 86 and the free edge 92 of the skirt 90 which is bent into a longitudinal groove 94 in the face of the locking element 88 directed toward the glass panel of the door, not itself seen in FIG. 4. The skirt 90 gives the top portion of the cover 82 the approximate shape of a channel. The lower edge portion 106 of the cover 82 is bent around the lower edge face of the bar 84 which is formed with a groove 108 for brushes.

While the invention has been described with reference to a fitting assembly for the bottom edge of a glass door, it is applicable in an obvious manner to panels of other materials, to framed panels, and to panel edges other than the bottom edge since it does not rely on gravity for its operativeness.

It should be understood, therefore, that the foregoing disclosure relates only to presently preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. An edge fitting assembly for a panel comprising:

(a) a bar member elongated in a predetermined direction, (1) said bar member having two narrow, longitudinal edge faces and a wide, longitudinal face connecting said edge faces, (2) at least one of said edge faces being formed with a longitudinal groove;

(b) cover means having two first portions respectively enveloping said edge faces and a second portion enveloping said wide face, at least said first portion enveloping said edge face formed with a longitudinal groove defining a longitudinal groove opposite the groove of the enveloped edge face;

(c) securing means on said bar member for securing said bar member to the panel; and (d) a locking member simultaneously received in the opposite grooves of said edge face with a longitudinal groove and said first portion enveloping said edge face with a longitudinal groove and preventing movement of said second portion of said cover means away from said wide face of said bar member.

2. An assembly as set forth in claim 1, wherein said locking member is elongated and dimensioned for longitudinal sliding movement in the receiving grooves.

3. An assembly as set forth in claim 2, wherein said locking member consists essentially of elastomeric material.

4. An assembly as set forth in claim 3, wherein said locking element is tubular and slotted longitudinally.

5. An assembly as set forth in claim 1, wherein said cover means include a cover member of sheet material enveloping said faces of said bar member, said first portion enveloping said edge face with a longitudinal groove includes an elongated rod member formed with said groove therein and interposed between said cover member and said at least one edge face.

6. An assembly as set forth in claim 5, wherein said rod member is formed with another longitudinal groove, an elongated sealing element positioned in said another groove, and said sealing element projecting transversely from said groove toward a panel secured by said securing means.

7. An assembly as set forth in claim 1, wherein said securing means include two block members fastened to said bar member in longitudinally spaced relationship, said block members being formed with respective, panel-receiving grooves aligned in said direction.

8. An assembly as set forth in claim 7, further comprising an additional bar member elongated in said direction and secured to said block members, said bar members having respective opposite faces receiving said block members therebetween and being each formed with a longitudinal groove, and a brush, respective portions of said brush being received in the grooves in said opposite faces of the bar members.

9. An assembly as set forth in claim 1, wherein said cover means includes a cover member of sheet material having an approximately channel-shaped portion defining said groove in said first portion enveloping said edge face with a longitudinal groove.

10. An assembly as set forth in claim 9, wherein said locking member is elongated in said direction and formed with a longitudinal groove open in a direction away from said second portion of the cover means, said channel-shaped portion having an edge part received in said groove of the locking member.

11. An assembly as set forth in claim 9, wherein said locking member consists essentially of plastic.

12. An edge fitting assembly for a panel comprising:

(a) two bar members elongated in a common direction and spaced from each other in a direction perpendicular to said common direction;

(b) two fastening blocks releasably secured between said bar members and at least partly covered by said bar members, said blocks being spaced from each other in said common direction, (1) each fastening block defining a panel-receiving groove aligned with the groove in the other fastening block and open in a direction transverse to said common direction and to said perpendicular direction.

13. An edge fitting assembly for one edge of a panel, such as a glass pane, comprising at least two fastening blocks located at spaced positions along the length of the edge of the panel, each said fastening block comprising two parts each extending outwardly from an opposite face surface of the panel, a cover plate located on each of the opposite sides of the edge of the panel and extending along the length of the edge of the panel and covering each of the spaced said fastening blocks, said covering plates being releasably fastened over said parts of said fastening blocks, a bar extending along each of the opposite sides of the edge of the panel and extending between and covering each of said parts of the spaced said fastening blocks on the same side of the panel, said bars being located between said fastening blocks and said cover plates and being releasably secured to said fastening blocks.

14. An edge fitting assembly, as set forth in claim 13, wherein said parts of each said fastening block being in interfitting engagement and each said part forming a portion of a groove for receiving the edge of the panel along the edge on which said fastening block extends.

15. An edge fitting assembly, as set forth in claim 14, wherein said bars being channel-shaped and having a web and a pair of legs each extending from an opposite edge of said web, said web abutting against the adjacent said part of said fastening block, and said legs extending over the surfaces of said part extending transversely of the surface of said part against which said web abuts.

16. An edge fitting assembly, as set forth in claim 15, wherein said covering plates being channel-shaped and each said covering plate fitting over said legs and web of one said bar.

* * * * *